US008022635B2

(12) United States Patent
Yoshida et al.

(10) Patent No.: US 8,022,635 B2
(45) Date of Patent: Sep. 20, 2011

(54) CCFL CONTROLLER WITH MULTI-FUNCTION TERMINAL

(75) Inventors: Yuji Yoshida, Irvine, CA (US); Xiaoping Jin, Orange, CA (US)

(73) Assignee: Microsemi Corporation, Garden Grove, CA (US)

( * ) Notice: Subject to any disclaimer, the term of this patent is extended or adjusted under 35 U.S.C. 154(b) by 384 days.

(21) Appl. No.: 12/469,702

(22) Filed: May 21, 2009

(65) Prior Publication Data

US 2009/0289569 A1 Nov. 26, 2009

Related U.S. Application Data

(60) Provisional application No. 61/055,989, filed on May 25, 2008.

(51) Int. Cl.
*H05B 37/02* (2006.01)

(52) U.S. Cl. ..... 315/209 R; 315/219; 315/307; 315/291; 315/DIG. 5; 315/DIG. 7

(58) Field of Classification Search ..... 315/209 R, 315/219, 307, 291, DIG. 5, DIG. 7
See application file for complete search history.

(56) References Cited

U.S. PATENT DOCUMENTS 4,866,311 A 9/1989 Skoutas
5,331,253 A * 7/1994 Counts ..... 315/209 R
6,008,590 A 12/1999 Giannopoulos
6,163,186 A * 12/2000 Kurita ..... 327/157
6,979,959 B2 12/2005 Henry
RE39,065 E 4/2006 Nelson
7,164,240 B2 * 1/2007 Moyer et al. ..... 315/255
7,227,315 B2 * 6/2007 Shinbo et al. ..... 315/224
7,233,131 B2 6/2007 Lin
7,362,303 B2 * 4/2008 Jang ..... 345/102
7,531,966 B2 * 5/2009 Hwang et al. ..... 315/224
2001/0045849 A1 * 11/2001 Kurita ..... 327/156

OTHER PUBLICATIONS

Dallas Semiconductor, Maxim DS3988 Data Sheet, 8 Channel Cold-Cathode Fluorescent Lamp Controller, revision 0; Apr. 2005.
Linear Technology, LT1768 Data Sheet, High Power CCFL Controller for Wide Dimming Range and Maximum Lamp Lifetime.

* cited by examiner

*Primary Examiner* — Bao Q Vu
(74) *Attorney, Agent, or Firm* — Simon Kahn

(57) ABSTRACT

A cold cathode fluorescent lamp controller exhibiting a multi-function terminal and operative alternately in a strike mode and a run mode, the controller comprising: a phase locked loop arranged for synchronization of an oscillator, associated with the controller, with an external signal, the phase locked loop comprising a capacitor coupled to the multi-function terminal; and a soft start circuit arranged to limit drive current immediately after reset of the controller responsive to a signal at the multi-function terminal. In one embodiment the controller further comprises an error detection circuit arranged to output an error signal on the multi-function terminal. In one embodiment the controller further comprises a frequency sweeping circuit operative to sweep the frequency of a drive signal during the strike mode of the controller, the frequency of the drive signal being swept by the frequency sweeping circuit responsive to a signal at the multi-function terminal.

28 Claims, 6 Drawing Sheets

CCFL CONTROLLER WITH MULTI-FUNCTION TERMINAL

CROSS-REFERENCE TO RELATED APPLICATIONS

This application claims priority from U.S. Provisional Patent Application Ser. No. 61/055,989 filed May 25, 2008, entitled "CCFL Controller with Multi-Function Terminal", the entire contents of which is incorporated herein by reference.

BACKGROUND OF THE INVENTION

The invention relates generally to integrated circuits, and in particular to a cold cathode fluorescent lamp controller exhibiting a multi-function terminal.

Cold Cathode Fluorescent Lamps (CCFL) are extensively used today as backlights for computer liquid crystal displays (LCD) and LCD televisions. In certain embodiments CCFL lamps are driven in a push pull configuration such that current flows alternatively in each direction to ensure long life and uniform operation. A CCFL driver, and a controller operative with such a driver preferably provides a pair of complementary drive signals which are out of phase with each other. Typically, a CCFL driver requires a pair of driving signals which are 180° out of phase with each other, however this is not meant to be limiting in any way and 90° phase difference is also required in some particular applications.

Systems that use a plurality of CCFL lamps for a single display require synchronization between the CCFL drivers so as to avoid interference caused by non-synchronized operation. Further synchronization is often required with a system display signal, such as a video scanning signal, associated with a horizontal scanning frequency, so as to avoid a water wave effect. Such synchronization is required for single and multiple CCFL driver systems and thus requires an input terminal for receipt of any synchronization signal. Synchronization is typically accomplished with a phase locked loop which typically requires an external filtering capacitor accessed via another input terminal.

Ignition of a CCFL, also known as striking, requires a high voltage applied for a short period of time to ionize the gas within the fluorescent tube. Once ignition has been achieved a lower voltage is sufficient to maintain the CCFL in an on condition, known as the run state. CCFLs are often driven by a converter circuit, responsive to a CCFL controller, operative to convert an input DC signal to the AC waveform required to drive the CCFL in either the strike mode or the operating mode.

U.S. Pat. No. 6,979,959 issued Dec. 27, 2005 to Henry, the entire contents of which is incorporated herein by reference, is addressed to a lamp inverter with a continuous strike voltage exhibiting a frequency sweep generator. The frequency sweep generator sweeps the frequency of the lamp inverter to a striking frequency corresponding to a striking lamp voltage and then maintains the striking frequency until the lamp strikes. In certain embodiments, the frequency sweep generator is responsive to a voltage across an external capacitor, whose charge over time increases resulting in the sweeping of the frequency of the sweep generator. Such a capacitor is typically user selected, and of a value too large to be economically integrated within an integrated circuit. Thus, striking using a swept frequency requires an additional input terminal.

An integrated circuit providing the electronic control for striking and running the CCFL is termed hereinafter a CCFL controller.

A soft start function is also typically supported, which prevents start up over shoot during the strike mode. Such an over shoot is typically the result of an error amplifier indicating that substantially no current is flowing during strike mode until the lamp lights, and thus calling for increased on time for a pulse width modulation circuit. In the absence of a soft start function, upon ignition of the lamp a maximal amount of current will flow without limitation until the error amplifier senses the overflow and acts to reduce the current flow. Such a soft start function typically thus requires a timing capacitor, with yet additional associated input terminal.

In the event of an error condition being sensed by the CCFL controller, it would be advantageous to supply an error signal which may be sensed by the system electronics. Such an error signal requires yet another associated terminal.

In electronics the cost of each terminal of integrated circuit adds cost. Thus, it would be desirable to provided a multi-function terminal arranged to serve in place of at least some of the dedicated terminals of the prior art.

SUMMARY OF THE INVENTION

According to certain embodiments of the present invention, a cold cathode fluorescent lamp controller is provided exhibiting a multi-function terminal and operative alternately in a strike mode and a run mode. In certain embodiments the controller comprises: a phase locked loop arranged for synchronization of an oscillator, associated with the controller, with an external signal, the phase locked loop comprising a capacitor coupled to the multi-function terminal; and a soft start circuit arranged to limit drive current immediately after reset of the controller responsive to a signal at the multi-function terminal.

In one particular embodiment the cold cathode fluorescent lamp controller further comprises a frequency sweeping circuit operative to sweep the frequency of the drive signal output during the strike mode. The frequency sweeping circuit is preferably operative to sweep the frequency responsive to a signal at the multi-function terminal In one particular embodiment, the cold cathode fluorescent lamp controller further comprises an error detection circuit, operative to detect an error in operation such as a failure of the lamp to be ignited or a persistent over current or over voltage condition. In the event of an error condition, an error signal is asserted at the multi-function terminal. Thus, in such an embodiment the multi-function terminal is further an output terminal of the cold cathode fluorescent lamp controller.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding sections or elements throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF THE PREFERRED EMBODIMENTS

Figure 1:
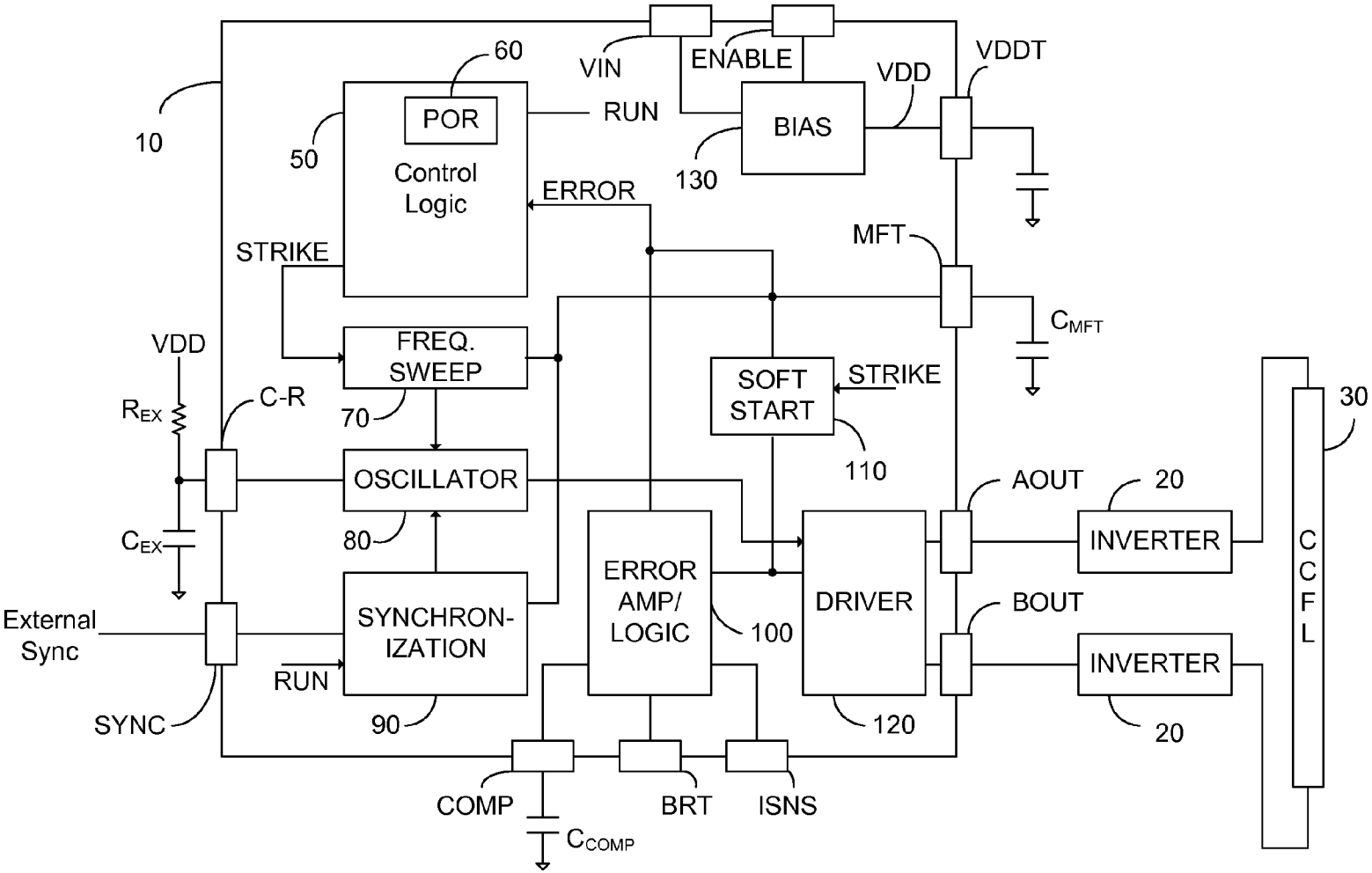
FIG. 1 illustrates a high level functional block diagram of an embodiment of a CCFL controller, with associated inverters and a CCFL in accordance with certain embodiments.

The present embodiments enable a cold cathode fluorescent lamp controller exhibiting a multi-function terminal and operative alternately in a strike mode and a run mode. In certain embodiments the controller comprises: a phase locked loop arranged for synchronization of an oscillator, associated with the controller, with an external signal, the phase locked loop comprising a capacitor coupled to the multi-function terminal; and a soft start circuit arranged to limit drive current immediately after reset of the controller responsive to a signal at the multi-function terminal.

In one particular embodiment the cold cathode fluorescent lamp controller further comprises a frequency sweeping circuit operative to sweep the frequency of the drive signal output during the strike mode. The frequency sweeping circuit is preferably operative to sweep the frequency responsive to a signal at the multi-function terminal In one particular embodiment, the cold cathode fluorescent lamp controller further comprises an error detection circuit, operative to detect an error in operation such as a failure of the lamp to be ignited or a persistent over current or over voltage condition. In the event of an error condition, an error signal is asserted at the multi-function terminal. Thus, in such an embodiment the multi-function terminal is further an output terminal of the cold cathode fluorescent lamp controller.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 illustrates a high level functional block diagram of an embodiment of a CCFL controller 10, with associated inverters 20 and a CCFL 30 in accordance with certain embodiments. CCFL controller 10 comprises: a control logic 50 comprising therein a power on reset functionality 60; a frequency sweeping functionality 70; an oscillator 80; a synchronization functionality 90; an error amplifier and error logic functionality 100; a soft start functionality 110; a driver 120; and a bias circuit 130 generating a regulated voltage VDD. CCFL controller 10 further exhibits a plurality of terminals denoted respectively C-R, SYNC, COMP, BRT, ISNS, MFT, AOUT, BOUT, VDDT, VIN and ENABLE, with terminal MFT being a multi-function terminal.

Control logic 50 operates CCFL controller 10 in one of 2 modes, a strike mode and a run mode, with the modes being implemented responsive to a pair of outputs denoted STRIKE and RUN. In one embodiment, a single output is provided with its complement being taken as the second output. For example, in one embodiment a single RUN output is provided, and in the absence of an active signal on the RUN output a STRIKE mode is understood. In another embodiment a single STRIKE output is provided, and in the absence of an active signal on the STRIKE output a RUN mode is understood.

Each of multi-function terminal MFT and terminal COMP have coupled thereto a respective external capacitor to ground, denoted respectively $C_{MFT}$ and $C_{COMP}$. Terminal C-R has coupled thereto a first end of a resistor $R_{EX}$, whose second end is coupled to regulated voltage VDD, and a first end of a capacitor $C_{EX}$, whose second end is coupled to a ground terminal, or other common point.

The term ground, as used throughout this document, is directed towards a common point, which need not necessarily be coupled to physical ground or a chassis ground.

The STRIKE output of control logic 50 is coupled to an input of frequency sweeping functionality 70 and to an input of soft start functionality 110. The RUN output of control logic 50 is coupled to an input of synchronization functionality 90.

The output of frequency sweeping functionality 70 is coupled as a control input to oscillator 80, and an input of frequency sweeping functionality 70 is coupled to multi-function terminal MFT. Respective connections of synchronization functionality 90 are coupled to an external synchronization signal via terminal SYNC, to multi-function terminal MFT and to an input of oscillator 80. Oscillator 80 is coupled to terminal C-R and to an input of driver 120. Inputs of error amplifier and error logic functionality 100 are respectively coupled to each of terminal COMP, terminal BRT and terminal ISNS, one output of error amplifier and error logic functionality 100 is coupled to an input of driver 120 and to soft start functionality 110 and one output of error amplifier and error logic functionality 100, denoted ERROR is coupled to an input of control logic 50 and to multi-function terminal MFT.

Driver 120 exhibits a pair of outputs coupled respectively via terminals AOUT and BOUT to inputs of respective inverters 20. Inverters 20 are arranged to drive alternately both ends of CCFL 30.

Bias circuit 130 exhibits a control input terminal coupled to the ENABLE terminal, a power input terminal coupled to the VIN terminal, and an output terminal exhibiting regulated voltage VDD coupled to the VDDT terminal. Bias circuit 130 is operative responsive to an active signal at the ENABLE terminal to generate a regulated voltage VDD appearing at terminal VDDT from an input voltage appearing at terminal VIN. Terminal VDDT is preferably externally supplied with a low ESR decoupling capacitor, connected to ground, of not less than 1 μF with low impedance traces. In an alternative embodiment (not shown) an external regulated voltage can be supplied to terminal VDD, which is then connected directly to the voltage input pin VIN thereby overriding the internal voltage regulator.

The above listing of terminals is not meant to be limiting in any way. In one embodiment additional terminals are provided for one or more of: a ground connection; a voltage sense input arranged to sense a voltage condition associated with the output, preferably associated with CCFL 30; a lamp strike time and/or fault protection time RC timing circuit; a burst dimming frequency RC timing circuit; and a burst dimming control input operative to select a continuous analog brightness control mode responsive to a first range of input values, a direct duty cycle control mode responsive to a second range of input values, and a disable input responsive to a third range of values.

In particular embodiments each of power on reset functionality 60, frequency sweeping functionality 70, synchronization functionality 90, error amplifier and error logic functionality 100 and soft start functionality 110 are implemented in dedicated circuitry, denoted respectively power on reset circuitry 60, frequency sweeping circuitry 70, synchronization circuitry 90, error amplifier and error logic circuitry 100 and soft start circuitry 110, however this is not meant to be limiting in any way. In other embodiments one or more of power on reset functionality 60, frequency sweeping functionality 70, synchronization functionality 90, error amplifier and error logic functionality 100 and soft start functionality 110 are implemented by general purpose logic or electronic circuits, such as a micro-controller, micro-computer or programmable gate array without exceeding the scope of the invention. For ease of understanding, an implementation of an embodiment of the functional block diagram of controller 10 will be described below in relation to specific circuitry of FIGS. 2-5.

In operation, power on reset functionality 60 of control logic 50 senses a power on reset condition, and ensures that all circuitry of control logic 50 is functioning prior to beginning operation. Additionally, in one embodiment power on reset functionality 60 further acts to discharge capacitor $C_{MFT}$, via a switch (not shown) to ground. Control logic 50 then asserts the STRIKE mode, preferably by asserting an active signal on the STRIKE output.

Frequency sweeping functionality 70 is operative in the STRIKE mode to sweep the frequency of oscillator 80 responsive to a signal at multi-function terminal MFT. In one embodiment, a current source is provided as part of one of soft start functionality 110 and frequency sweep functionality 70, operative to charge capacitor $C_{MFT}$ at a controlled rate thereby providing a controlled frequency sweep. Sweeping the frequency of oscillator 80 advantageously seeks the resonant frequency of the circuit containing CCFL 30 so as to provide an appropriate striking voltage across CCFL 30 for ignition.

Soft start functionality 110 is operative in the STRIKE mode to limit the input received by driver 120 from error amplifier and error logic functionality 100. In particular, error amplifier and error logic functionality 100 is operative to compare a brightness request signal appearing at terminal BRT with a current sense signal, coupled to represent current through CCFL 30, appearing at terminal ISNS, and control the duty cycle of the outputs of driver 120 so as to compensate for any undercurrent condition. During STRIKE mode, until ignition of CCFL 30 occurs, no appreciable current is sensed at ISNS, and thus error amplifier and error logic functionality 100 would signal driver 120 to output at a maximum duty cycle. Unfortunately, upon ignition of CCFL 30, an overshoot condition may then occur. This overshoot condition is controlled by soft start functionality 110 as described above. In one embodiment the BRT terminal represents an analog brightness control input.

In one embodiment, during the STRIKE mode, error amplifier and error logic functionality 100 is further operative to sense a voltage component across CCFL 30, to monitor the current through CCFL 30 sensed via terminal ISNS, and to monitor the duration of the STRIKE mode. In the event that the STRIKE mode duration exceeds a predetermined value, the voltage exceeds a predetermined limit for a predetermined maximum time period, or the current sensed via terminal ISNS exceeds a predetermined limit for a predetermined maximum time period, an error condition is noted on output ERROR, which is preferably output at multi-function terminal MFT to be sensed by an external control circuitry (not shown). Control logic 50 is further operative to shut down operation responsive to an active signal appearing on the ERROR output of error amplifier and error logic functionality 100.

In the event that ignition of CCFL 30 is sensed by control logic 50, control logic 50 asserts the RUN mode, preferably by asserting an active signal on the RUN output, and deasserting an active signal from the STRIKE output. Soft start functionality 110 and frequency sweeping functionality 70 shut down responsive to the RUN mode and synchronization functionality 90 becomes active. Synchronization functionality 90 is operative to detect a synchronization signal appearing at terminal SYNC, and if present, to synchronize the operation of oscillator 80 to the synchronization signal at terminal SYNC. In one embodiment, synchronization functionality 90 is embodied in a phase locked loop (PLL). Synchronization functionality 90 is coupled to multi-function terminal MFT, and utilizes capacitor $C_{MFT}$ as a low pass filter to reduce response to transients and noise.

In one embodiment, during RUN mode, error amplifier and error logic functionality 100 is further operative to sense a voltage component across CCFL 30 and to monitor the current through CCFL 30 sensed via terminal ISNS. In the event that the voltage exceeds a predetermined limit for a predetermined maximum time period, or the current sensed via terminal ISNS exceeds a predetermined limit for a predetermined maximum time period, an error condition is noted on output ERROR, which is preferably output at multi-function terminal MFT to be sensed by an external control circuitry (not shown). Control logic 50 is further operative to shut down operation responsive to an active signal appearing on the ERROR output of error amplifier and error logic functionality 100.

Figure 2:
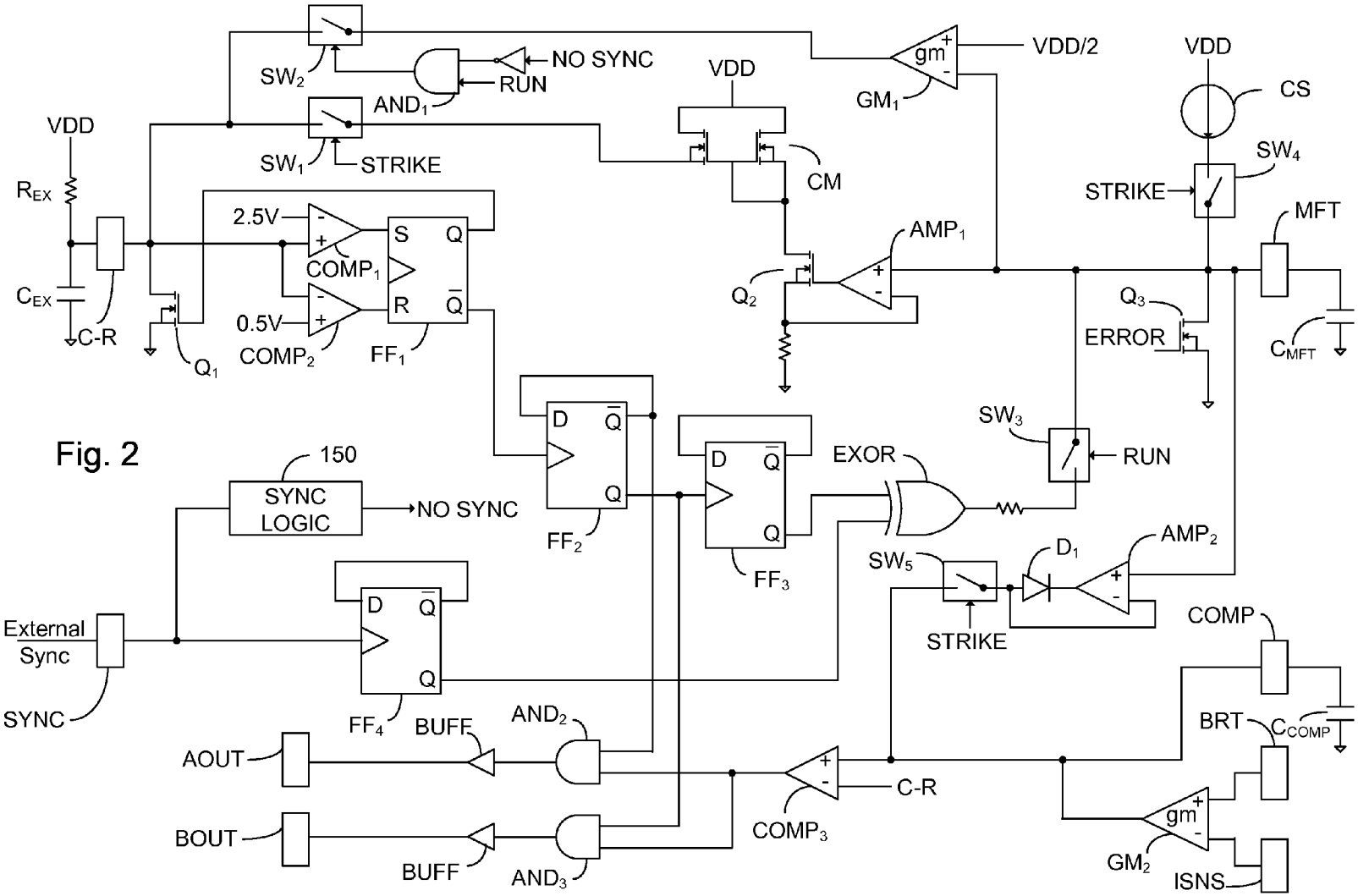
FIG. 2 illustrates a high level schematic diagram of an embodiment of the CCFL controller of FIG. 1 in accordance with certain embodiments.

FIG. 2 illustrates a high level schematic diagram of an embodiment of CCFL controller 10 of FIG. 1 in accordance with certain embodiments comprising: a plurality of switches denoted $SW_1$, $SW_2$, $SW_3$, $SW_4$ and $SW_5$, each arranged to be closed electronically responsive an active input signal; a plurality of AND gates denoted respectively $AND_1$, $AND_2$ and $AND_3$, a plurality of flip flops denoted respectively $FF_1$, $FF_2$, $FF_3$ and $FF_4$ of which flip flop $FF_1$ is an S-R type and flip flops $FF_2$, $FF_3$ and $FF_4$ are D types; a plurality of op-amps denoted respectively $AMP_1$ and $AMP_2$; a plurality of buffers denoted BUFF; a current mirror denoted CM; a plurality of FET switches, denoted respectively $Q_1$, $Q_2$ and $Q_3$; a current source denoted CS; a plurality of transconductance amplifiers denoted respectively $GM_1$ and $GM_2$; a plurality of comparators denoted respectively $COMP_1$, $COMP_2$ and $COMP_3$; an exclusive OR gate denoted EXOR; a diode $D_1$; and a synchronization signal detection logic 150. Terminals C-R, SYNC, AOUT, BOUT, ISNS, BRT, COMP and MFT are further illustrated, as described above in relation to FIG. 1, including their respective capacitors, ($C_{EX}$, $C_{COMP}$, $C_{MFT}$) and resistor ($R_{EX}$).

Terminal SYNC is coupled to the input of synchronization signal detection logic 150 and to the clocking input of flip flop $FF_4$. The output of synchronization signal detection logic 150, denoted NO SYNC, is coupled via an inverter to a first input of AND gate $AND_1$. The Q bar output of flip flop $FF_4$ is coupled to the D input of flip flop $FF_4$, and the Q output of flip flop $FF_4$ is coupled to a first input of exclusive OR gate EXOR.

Terminal C-R is coupled to: the inverting input of comparator $COMP_2$; the non-inverting input of comparator $COMP_1$; a first end of switch $SW_1$; a first end of switch $SW_2$; and the drain of FET switch $Q_1$. The source of FET switch $Q_1$ is coupled to ground, and the gate of FET switch $Q_1$ is coupled to the Q output of flip flop $FF_1$. As described above in relation to FIG. 1, terminal C-R has further coupled thereto a first end of resistor $R_{EX}$, whose second end is coupled to regulated voltage VDD and a first end of capacitor $C_{EX}$, whose second end is coupled to a ground terminal.

The inverting input of comparator $COMP_1$ is coupled to a predetermined voltage point, particularly 2.5 Volts, although other values may be selected as required. The non-inverting input of comparator $COMP_2$ is coupled to a predetermined voltage point, particularly 0.5 Volts, although other values may be selected as required. The output of comparator $COMP_1$ is connected to the set input of flip flop $FF_1$ and the output of comparator $COMP_2$ is connected to the reset input of flip flop $FF_1$.

The Q bar output of flip flop $FF_1$ is coupled to the clocking input of flip flop $FF_2$. The Q bar output of flip flop $FF_2$ is coupled to the D input of flip flop $FF_2$, and to a first input of AND gate $AND_2$. The Q output of flip flop $FF_2$ is coupled to the clocking input of flip flop $FF_3$ and to a first input of AND gate $AND_3$. The Q bar output of flip flop $FF_3$ is coupled to the D input of flip flop $FF_3$, and the Q output of flip flop $FF_3$ is coupled to the second input of exclusive OR gate EXOR.

The output of exclusive OR gate EXOR is coupled via a resistor to a first end of switch $SW_3$. The control input of switch $SW_3$ is coupled to the RUN output of control logic 50 of FIG. 1. The second end of switch $SW_3$ is coupled to multi-function terminal MFT, the inverting input of transconductance amplifier $GM_1$, the non-inverting input of op-amp $AMP_1$, the drain of FET switch $Q_3$, the non-inverting input of op-amp $AMP_2$ and a first end of switch $SW_4$. As described above in relation to FIG. 1, multi-function terminal MFT is further coupled to a first end of capacitor $C_{MFT}$, and the second end of capacitor $C_{MFT}$ is coupled to ground.

The source of FET switch $Q_3$ is coupled to ground, and the gate of FET switch $Q_3$ is coupled to the ERROR output of error amplifier and error logic functionality 100 of FIG. 1. The control input of switch $SW_4$ is coupled to the STRIKE output of control logic 50 of FIG. 1, and the second end of switch $SW_4$ is coupled to the output of current source CS. In one particular embodiment, current source CS is a 2.5 μA current source, which is low enough to ensure, in cooperation with a properly sized capacitor $C_{MFT}$ a slowly rising voltage during charging of capacitor $C_{MFT}$. In one particular embodiment, capacitor $C_{MFT}$ is constituted of a 0.1 μF capacitor appropriate for use with the 2.5 μA current source of current source CS. The input of current source CS is coupled to regulated voltage VDD.

The inverting input of op-amp $AMP_1$ is coupled to the source of FET switch $Q_2$ and to a first end of a resistor, whose second end is coupled to ground. The output of op-amp $AMP_1$ is coupled to the gate of FET switch $Q_2$, and the drain of FET switch $Q_2$ is coupled to the reference current input of current mirror CM. Current mirror CM is implemented as a pair of FETs, whose drains are commonly coupled to regulated voltage VDD, and whose gates are commonly coupled to the drain of FET switch $Q_2$. The source of a first one of the FETs of current mirror CM, representing the reference current input, is coupled as described above to the drain of FET switch $Q_2$. The source of a second one of the FETs of current mirror CM is coupled to a second end of switch $SW_1$. The control input of switch $SW_1$ is coupled to the STRIKE output of control logic 50 of FIG. 1.

The non-inverting input of transconductance amplifier $GM_1$ is coupled to a fixed voltage reference. In one particular embodiment, the fixed voltage reference is VDD/2, i.e. ½ of the source voltage thereby providing a wide working range for transconductance amplifier $GM_1$. The output of transconductance amplifier $GM_1$ is coupled to a second end of switch $SW_2$. The RUN output of control logic 50 of FIG. 1 is coupled to a second input of AND gate $AND_1$, and the output of AND gate $AND_1$ is coupled to the control input of switch $SW_2$.

The inverting input of op-amp $AMP_2$ is coupled to the anode of diode D1 and to a first end of switch $SW_5$. The output of op-amp $AMP_2$ is coupled to the cathode of diode D1 and the control input of switch $SW_5$ is coupled to the STRIKE output of control logic 50 of FIG. 1. A second end of switch $SW_5$ is coupled to the non-inverting input of comparator $COMP_3$, the output of transconductance amplifier $GM_2$, and terminal COMP. The inverting input of comparator $COMP_3$ is coupled to terminal C-R and the output of comparator $COMP_3$ is coupled a second input of each of AND gates $AND_2$ and $AND_3$. The output of AND gate $AND_2$ is fed via a respective buffer BUFF to the AOUT terminal, and the output of AND gate $AND_3$ is fed via a respective buffer BUFF to the BOUT terminal. The non-inverting input of transconductance amplifier $GM_2$ is connected to terminal BRT and the inverting input of transconductance amplifier $GM_2$ is connected to terminal ISNS. As described above in relation to FIG. 1, terminal COMP is further coupled to a first end of capacitor $C_{COMP}$, and the second end of capacitor $C_{COMP}$ is coupled to ground.

Selected portions of the high level schematic diagram of FIG. 2 are repeated in each of FIGS. 3-5, for clarity of understanding, and are referred to in the below discussion on operation.

Figure 3:
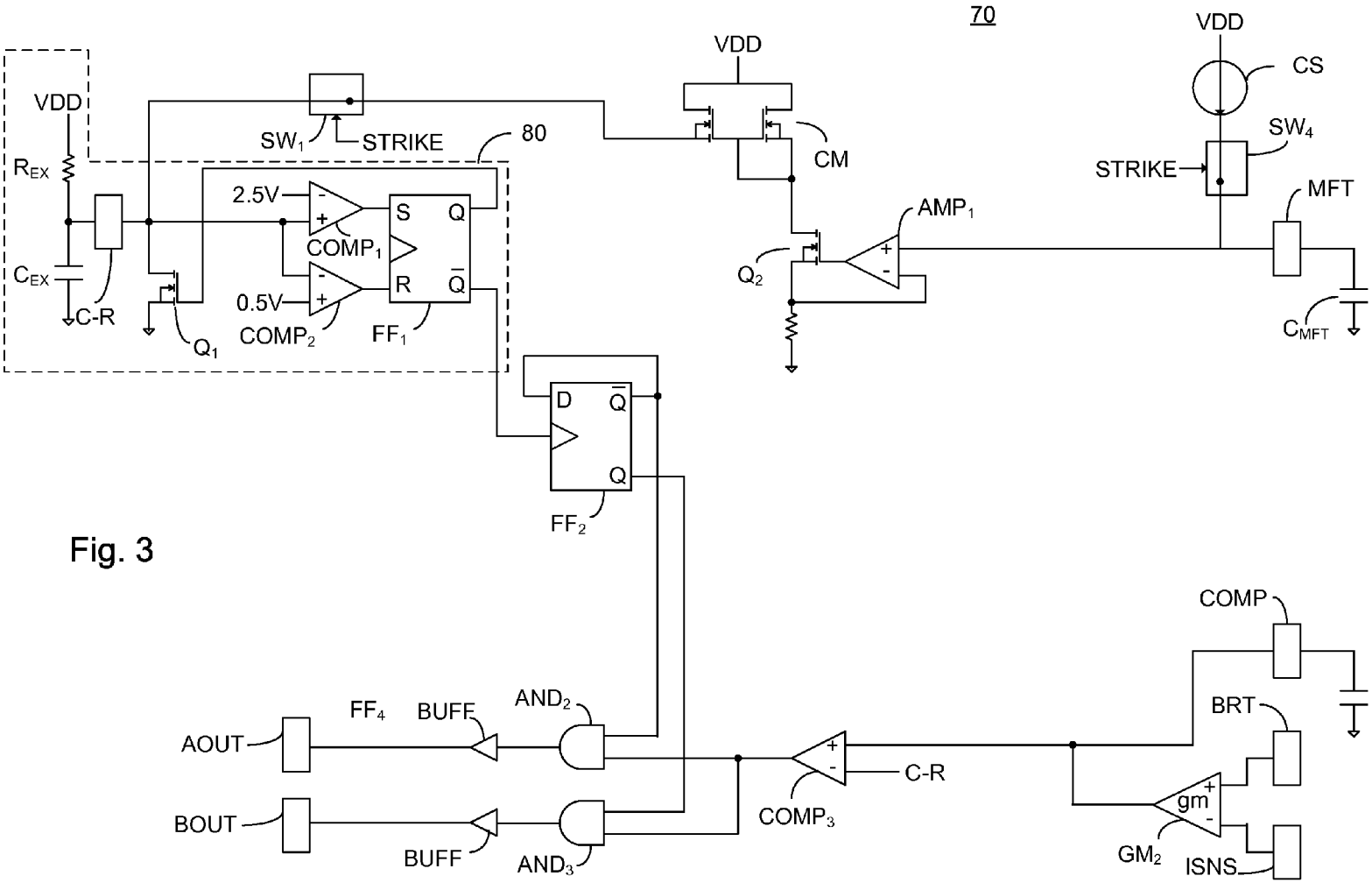
FIG. 3 illustrates a high level schematic diagram of the frequency sweeping circuit of the CCFL controller embodiment of FIG. 2 during STRIKE mode.
Figure 4:
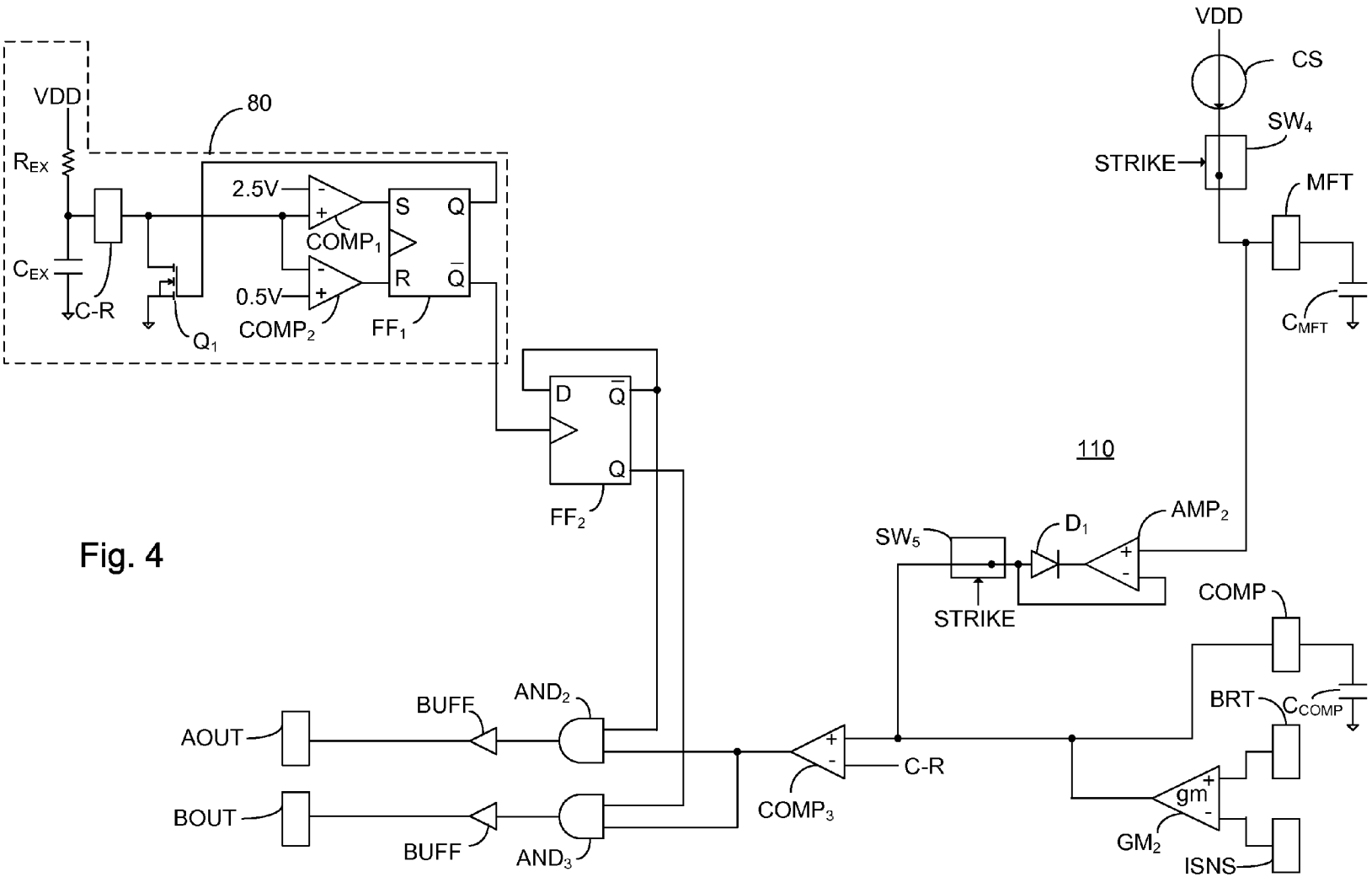
FIG. 4 illustrates a high level schematic diagram of the soft start circuit of the CCFL controller embodiment of FIG. 1 during STRIKE mode.

FIG. 3 illustrates a high level schematic diagram of frequency sweeping circuitry 70 of the CCFL controller embodiment of FIG. 1 during STRIKE mode and FIG. 4 illustrates a high level schematic diagram of soft start circuitry 110 of the CCFL controller embodiment of FIG. 1 during STRIKE mode. In STRIKE mode, switches $SW_1$, $SW_4$ and $SW_5$ are closed, and switches $SW_2$, $SW_3$ are open. Thus, the circuitry associated with the side of $SW_2$ and $SW_3$ which are decoupled are not shown in FIGS. 3 and 4.

Referring to FIG. 3, the combination of FET switch $Q_1$, resistor $R_{EX}$, capacitor $C_{EX}$, comparators $COMP_1$ and $COMP_2$, and flip flop $FF_1$ form oscillator 80 producing a saw tooth waveform within boundaries defined on the high side by the voltage at the inverting input to comparator $COMP_1$ and on the low side by the voltage at the non-inverting input to comparator $COMP_2$.

During the STRIKE mode, current source CS begins to charge capacitor $C_{MFT}$. The rising voltage is amplified by op-amp $AMP_1$. The current flow through FET switch $Q_2$ is responsive to op-amp $AMP_1$ and acts as a current reference for current mirror CM. Thus, the rising voltage across capacitor $C_{MFT}$ results in current driven from current mirror CM into capacitor $C_{EX}$. The current from current mirror CM adds to the charge on capacitor $C_{EX}$ received via resistor $R_{EX}$, thus increasing the rise time of oscillator 80 resulting in an increased frequency.

The output of oscillator 80 is divided by 2 by the action of flip flop $FF_2$. The output of transconductance amplifier $GM_2$, representing the error component between BRT and ISNS, is compared with the oscillating waveform appearing at terminal C-R, thereby forming a square wave at the output of comparator $COMP_3$, with half the frequency of oscillator 80 and a duty cycle responsive to the error component. The square wave output of comparator $COMP_3$ is alternately fed to AOUT and BOUT by AND gates $AND_2$ and $AND_3$.

Referring to FIG. 4, the combination of op-amp $AMP_2$ and diode $D_1$ forms a voltage clamp coupled to the output of transconductance amplifier $GM_2$. Transconductance amplifier $GM_2$ represents the error amplifier portion of error amplifier and error logic functionality 100 of FIG. 1. The voltage clamp limits the voltage appearing at the non-inverting input of comparator $COMP_3$ to be no more than a voltage level responsive to the voltage appearing across capacitor $C_{MFT}$. The operation of the voltage clamp can be understood as follows: in the event that the voltage at the non-inverting input of comparator $COMP_3$ rises above the voltage at the non-inverting input of op-amp $AMP_2$, the output of op-amp $AMP_2$ will become negative, and diode $D_1$ will conduct thereby reducing the voltage appearing at the non-inverting input of comparator $COMP_3$. In the event that the voltage at the non-inverting input of comparator $COMP_3$ is below the voltage at the non-inverting input of op-amp $AMP_2$, diode $D_1$ does not conduct, and the voltage at the non-inverting input of op-amp $AMP_2$ is unaffected by the clamp. Thus, soft start functionality 110 is provided by limiting the amplitude of the output of the error amplifier, thereby limiting the duty cycle appearing at outputs AOUT and BOUT, responsive to the slowly rising voltage appearing across capacitor $C_{MFT}$ at multi-function terminal MFT.

Figure 5:
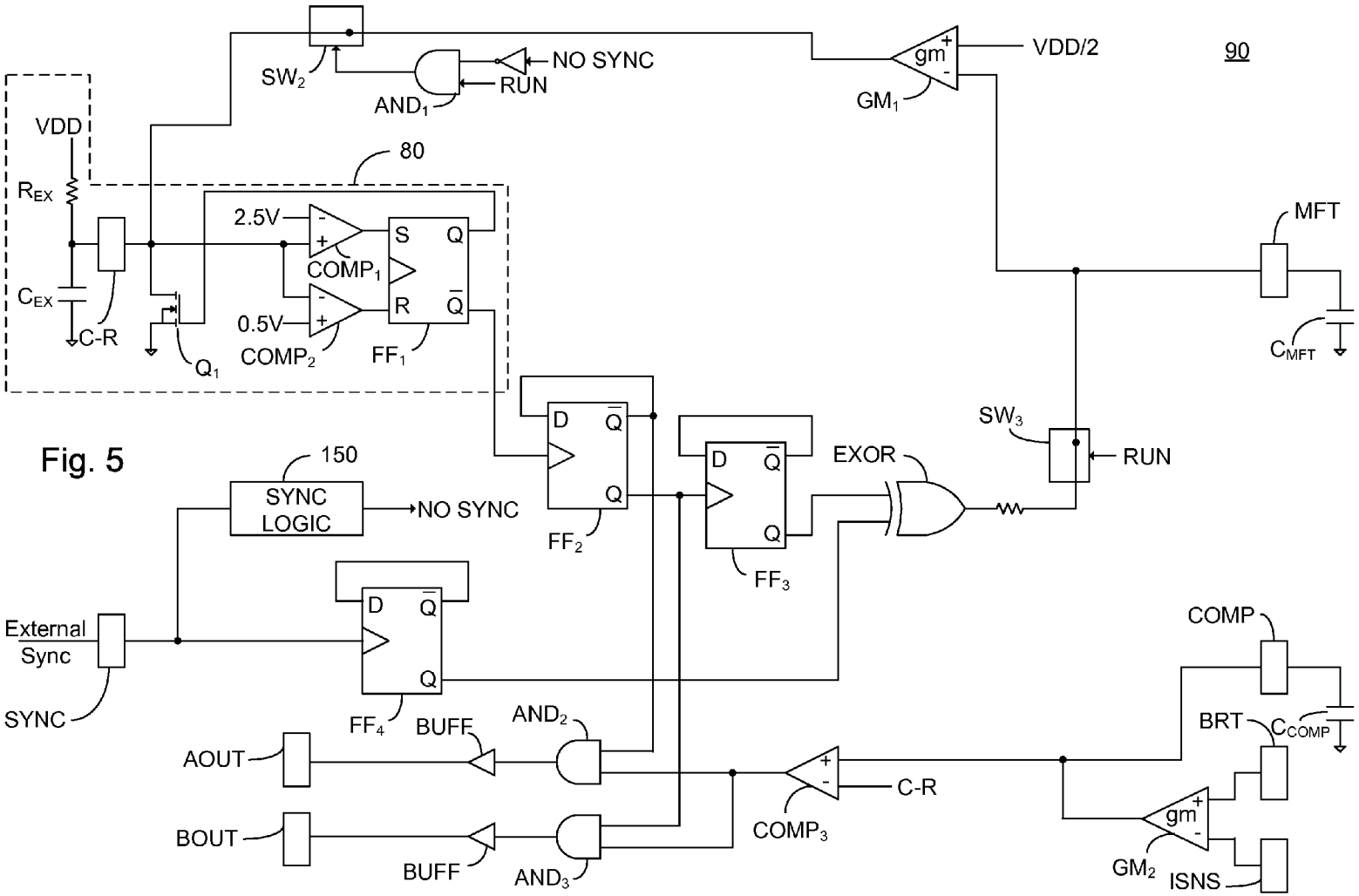
FIG. 5 illustrates a high level schematic diagram of the synchronization circuit of the CCFL controller embodiment of FIG. 1 during RUN mode.

FIG. 5 illustrates a high level schematic diagram of synchronization functionality 90 of the CCFL controller embodiment of FIG. 1 during RUN mode implemented as a PLL. In RUN mode, switches $SW_1$, $SW_4$ and $SW_5$ are open, and switches $SW_2$, $SW_3$ are closed. Thus, the circuitry associated with the side of $SW_1$, $SW_4$ and $SW_5$ which are decoupled are not shown in FIG. 5. As described above in relation to FIG. 3, oscillator 80 produces a saw tooth waveform at terminal C-R. A negative edge appears at the clocking input of flip flop $FF_2$ substantially contemporaneously with the falling edge of the saw tooth waveform at terminal C-R. In one embodiment each of flip flops $FF_2$, $FF_3$ and $FF_4$ are triggered by falling edges, and the operation will be described in relation thereto, however this is not meant to be limiting in any way, and positive edge triggered or level triggered flip flops may be utilized without exceeding the scope.

Flip flop $FF_2$ is arranged to divide the frequency appearing at the clock input of flip flop $FF_2$ by 2 by feeding the Q bar input to the D input. Similarly, flip flop $FF_3$ is arranged to divide the frequency appearing at the clock input of flip flop $FF_3$ by 2 by feeding the Q bar input to the D input. Thus the Q output of flip flop $FF_3$ is thus at ¼ the frequency of oscillator 80, i.e. ¼ of the frequency of the saw tooth waveform appearing at terminal C-R. As described above in relation to FIG. 3, terminals AOUT and BOUT exhibit a signal with a base frequency of ½ of the frequency of the saw tooth waveform appearing at terminal C-R. The external sync signal appearing at terminal SYNC is derived from an AOUT or BOUT signal of a similar CCFL controller. The SYNC signal is thus divided by 2 by the operation of flip flop $FF_4$, arranged to divide the frequency appearing at the clock input of flip flop $FF_4$ by 2 by feeding the Q bar input to the D input.

The outputs of flip flops $FF_3$ and $FF_4$ are coupled to respective inputs of exclusive OR gate EXOR, which exhibits at the output thereof a positive pulse whose width is a function of the difference between the signal appearing at terminal SYNC and the output of flip flop $FF_2$. The output is filtered by capacitor $C_{MFT}$, and coupled to the inverting input of transconductance amplifier $GM_1$. The non-inverting input of transconductance amplifier $GM_1$ is coupled to a fixed voltage point. In one particular embodiment, the fixed voltage point is VDD/2 thereby providing a wide working range for transconductance amplifier $GM_1$, as described above. It is to be understood that the voltage at multi-function terminal MFT during RUN mode is thus approximately equal to the fixed voltage point coupled to the non-inverting input of transconductance amplifier $GM_1$.

The difference between the voltage at multi-function terminal MFT, filtered by capacitor $C_{MFT}$, and the fixed voltage point, is amplified and output as current into, or taken from, capacitor $C_{EX}$. Thus, any difference between the signal appearing at terminal SYNC and oscillator 80 is compensated for by adjusting the rise time of the saw tooth waveform through transconductance amplifier $GM_1$.

Synchronization signal detection logic 150 is operative to detect the existence of, or absence of, a valid synchronizing signal at terminal SYNC. In the absence of a valid synchronizing signal at terminal SYNC, synchronization signal detection logic 150 asserts the NO SYNC output. AND gate $AND_1$ functions to disconnect synchronizing functionality 90 in either STRIKE mode or in the absence of a detected valid synchronizing signal responsive to the NO SYNC output.

Figure 6:
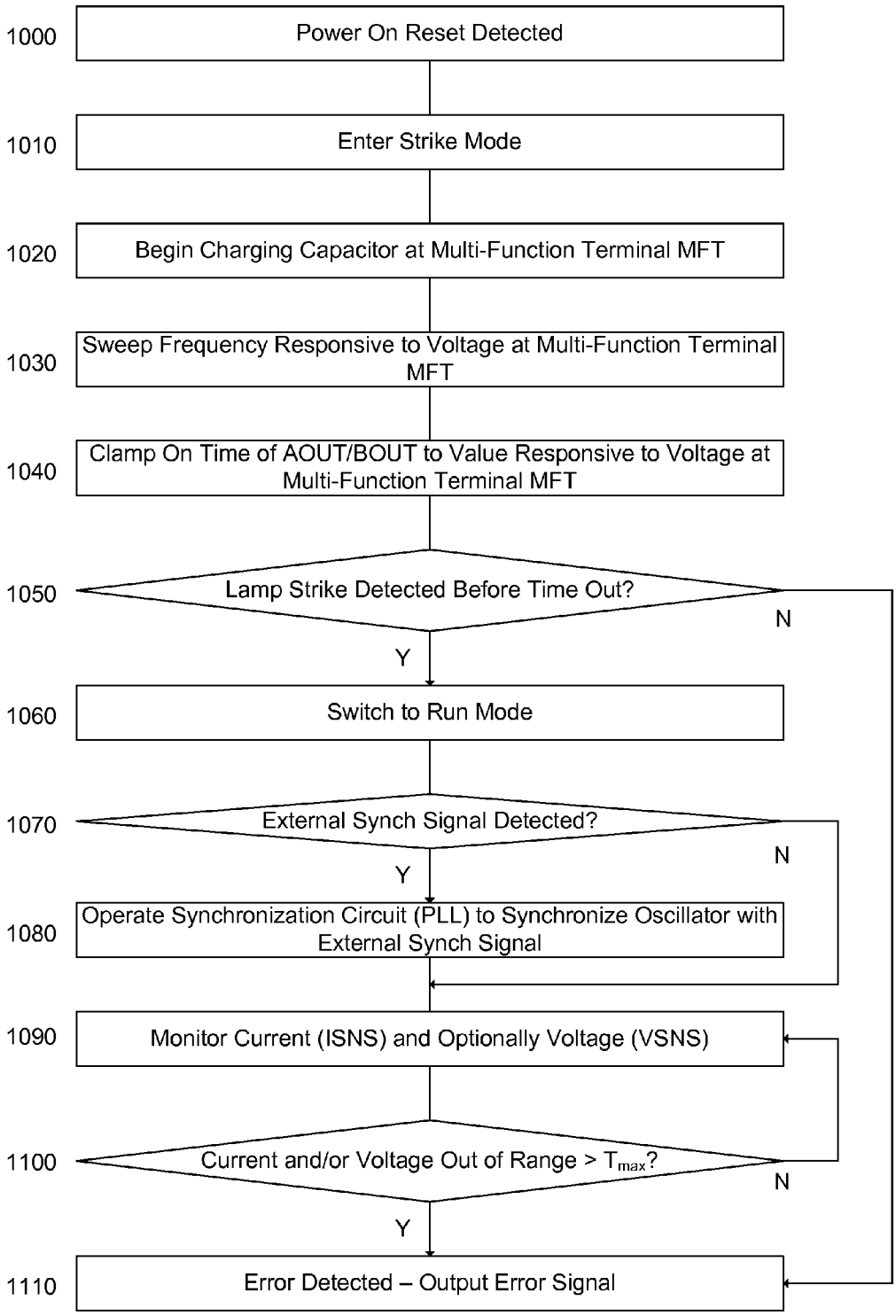
FIG. 6 illustrates a high level flow chart of the operation of the control logic and error logic of the CCFL controller of FIG. 1 according to certain embodiments.

FIG. 6 illustrates a high level flow chart of the operation of control logic 50 and the error logic of error amplifier and error logic functionality 100 of CCFL controller 10 of FIG. 1 according to certain embodiments of the inventions. In stage 1000, a power on reset is detected, preferably by power on reset functionality 60. Preferably, capacitor $C_{MFT}$ is discharged. In stage 1010, STRIKE mode is entered, i.e. an asserted STRIKE output is exhibited.

In stage 1020, capacitor $C_{MFT}$, at multi-function terminal MFT, begins to charge through current source CS at a controlled rate. In stage 1030, the frequency of oscillator 80 is swept responsive to the voltage across capacitor $C_{MFT}$ appearing at multi-function terminal MFT, as described in relation to frequency sweeping functionality 70 and in relation to FIG. 3. In stage 1040, which in one embodiment is contemporaneous with stage 1030, the on time of AOUT and BOUT are clamped responsive to the voltage appearing at multi-function terminal MFT, as described above in relation to soft start functionality 110 and in relation to FIG. 4.

In stage 1050, the time since the inception of stage 1010 is compared with a predetermined time out. In the event that lamp strike is detected prior to expiration of the predetermined time out, in stage 1060, RUN mode is entered, i.e. an asserted RUN output is exhibited.

In stage 1070, the signal appearing at terminal SYNC is examined, as described above in relation to synchronization signal detection logic 150 of FIG. 5. In the event that a valid synchronization is detected, in stage 1080, synchronization functionality 90, as described in relation to each of FIG. 1 and FIG. 5, is operated to synchronize oscillator 80 with the signal appearing at terminal SYNC.

In the event that in stage 1070 a valid synchronization is not detected, or upon initiation of stage 1080, in stage 1090 the current and optionally the voltage associated with CCFL 30 are monitored. In stage 1100, the monitored current and or voltage are compared with predetermined limits, which may be exceeded for a predetermined time, denoted $T_{max}$. In the event that one of the monitored current, or optionally monitored voltage, has exceeded the allowed range for more than $T_{max}$, in stage 1110, an error is detected, and the ERROR output of error amplifier and error detection functionality 100 is asserted. The ERROR output is coupled to the gate of FET switch $Q_3$, as described above in relation to FIG. 2, driving multi-function terminal MFT towards ground. It is to be noted that multi-function terminal MFT in normal operation exhibits a voltage of around VDD/2, as described above in relation to FIG. 5, and thus the lower voltage may be sensed by external monitoring equipment to indicate a fault condition on CCFL controller 10.

In the event that in stage 1100 none of the monitored current, or optionally monitored voltage, has exceeded the allowed range for more than $T_{max}$, stage 1090 is repeated.

In the event that in stage 1050 lamp strike is not detected prior to expiration of the predetermined time out, stage 1100 as described above is performed.

Optionally, stage 1090 may be further performed in STRIKE mode, as described above in relation to FIGS. 3 and 4.

Thus the present embodiments enable a cold cathode fluorescent lamp controller exhibiting a multi-function terminal and operative alternately in a strike mode and a run mode. In certain embodiments the controller comprises: a phase locked loop arranged for synchronization of an oscillator, associated with the controller, with an external signal, the phase locked loop comprising a capacitor coupled to the multi-function terminal; and a soft start circuit arranged to limit drive current immediately after reset of the controller responsive to a signal at the multi-function terminal.

In one particular embodiment the cold cathode fluorescent lamp controller further comprises a frequency sweeping circuit operative to sweep the frequency of the drive signal output during the strike mode. The frequency sweeping circuit is preferably operative to sweep the frequency responsive to a signal at the multi-function terminal.

In one particular embodiment, the cold cathode fluorescent lamp controller further comprises an error detection circuit, operative to detect an error in operation such as a failure of the lamp to be ignited or a persistent over current or over voltage condition. In the event of an error condition, an error signal is asserted at the multi-function terminal. Thus, in such an embodiment the multi-function terminal is further an output terminal of the cold cathode fluorescent lamp controller.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description.

We claim:

1. A cold cathode fluorescent lamp controller exhibiting a multi-function terminal and operative alternately in a strike mode and a run mode, the controller comprising:

a phase locked loop arranged for synchronization of an oscillator, associated with the controller, with an external signal, said phase locked loop comprising a capacitor coupled to the multi-function terminal; and a soft start circuit arranged to limit drive current immediately after reset of the controller responsive to a signal at the multi-function terminal.

2. A cold cathode fluorescent lamp controller according to claim 1, wherein said phase locked loop is arranged for synchronization of the associated oscillator with the external signal when the controller is in the run mode.

3. A cold cathode fluorescent lamp controller according to claim 1, further comprising an oscillator terminal, wherein the oscillator associated with the controller comprises an external capacitor coupled to the controller via said oscillator terminal.

4. A cold cathode fluorescent lamp controller according to claim 1, further comprising a synchronization terminal, wherein the external signal is coupled to the controller via said synchronization terminal.

5. A cold cathode fluorescent lamp controller according to claim 1, further comprising a frequency sweeping circuit operative to sweep the frequency of a drive signal output by the controller during the strike mode, the frequency of the drive signal being swept by the frequency sweeping circuit responsive to a signal at the multi-function terminal.

6. A cold cathode fluorescent lamp controller according to claim 5, wherein said frequency sweeping circuit comprises a current source coupled to the multi-function terminal during the strike mode.

7. A cold cathode fluorescent lamp controller according to claim 6, further comprising a capacitor coupled to the multi-function terminal, said capacitor being charged by said current source during the strike mode thereby providing the signal sweeping the frequency of the drive signal.

8. A cold cathode fluorescent lamp controller according to claim 1, wherein said soft start circuit is operative only in the strike mode.

9. A cold cathode fluorescent lamp controller according to claim 8, wherein said soft start circuit comprises a clamping circuit coupled to the output of an error amplifier, said clamping circuit arranged to limit the output of the error amplifier to a value responsive to the signal at the multi-function terminal.

10. A cold cathode fluorescent lamp controller according to claim 1, wherein said soft start circuit comprises a clamping circuit coupled to the output of an error amplifier, said clamping circuit arranged to limit the output of the error amplifier to a value responsive to the signal at the multi-function terminal.

11. A cold cathode fluorescent lamp controller according to claim 10, wherein said soft start circuit comprises a current source coupled to the multi-function terminal during the strike mode.

12. A cold cathode fluorescent lamp controller according to claim 11, further comprising a frequency sweeping circuit operative to sweep the frequency of a drive signal output by the controller during the strike mode, the frequency of the drive signal being swept by the frequency sweeping circuit responsive to a signal at the multi-function terminal, wherein said current source is further associated with said frequency sweeping circuit.

13. A cold cathode fluorescent lamp controller according to claim 1, further comprising an error detection circuit arranged to output an error signal on the multi-function terminal.

14. A cold cathode fluorescent lamp controller according to claim 13, wherein said error detection circuit is arranged to couple the multi-functional terminal to a ground potential thereby outputting the error signal.

15. A cold cathode fluorescent lamp controller comprising:

a multi-function terminal;

an oscillator;

a synchronization functionality arranged for synchronization of said oscillator with an external signal, said synchronization functionality comprising a capacitor coupled to said multi-function terminal; and a soft start functionality arranged to limit drive current immediately after reset of the controller responsive to a signal at said multi-function terminal.

16. A cold cathode fluorescent lamp controller according to claim 15, wherein said synchronization functionality is operative in a run mode of the controller.

17. A cold cathode fluorescent lamp controller according to claim 15, further comprising an oscillator terminal, wherein the oscillator comprises an external capacitor coupled to the controller via said oscillator terminal.

18. A cold cathode fluorescent lamp controller according to claim 15, further comprising a synchronization terminal, wherein the external signal is coupled to the controller via said synchronization terminal.

19. A cold cathode fluorescent lamp controller according to claim 15, further comprising a frequency sweeping functionality operative to sweep the frequency of a drive signal output by the controller during a strike mode of the controller, the frequency of the drive signal being swept by the frequency sweeping functionality responsive to a signal at said multi-function terminal.

20. A cold cathode fluorescent lamp controller according to claim 19, wherein said frequency sweeping functionality comprises a current source coupled to said multi-function terminal during the strike mode.

21. A cold cathode fluorescent lamp controller according to claim 20, further comprising a capacitor coupled to the multi-function terminal, said capacitor being charged by said current source during the strike mode thereby providing the signal sweeping the frequency of the drive signal.

22. A cold cathode fluorescent lamp controller according to claim 19, wherein said soft start functionality is operative only in the strike mode.

23. A cold cathode fluorescent lamp controller according to claim 22, wherein said soft start functionality comprises a clamping circuit coupled to the output of an error amplifier, said clamping circuit arranged to limit the output of the error amplifier to a value responsive to the signal at said multi-function terminal.

24. A cold cathode fluorescent lamp controller according to claim 15, wherein said soft start functionality comprises a clamping circuit coupled to the output of an error amplifier, said clamping circuit arranged to limit the output of the error amplifier to a value responsive to the signal at said multi-function terminal.

25. A cold cathode fluorescent lamp controller according to claim 24, wherein said soft start functionality comprises a current source coupled to said multi-function terminal during the strike mode.

26. A cold cathode fluorescent lamp controller according to claim 25, further comprising a frequency sweeping functionality operative to sweep the frequency of a drive signal output by the controller during the strike mode, the frequency of the drive signal being swept by the frequency sweeping functionality responsive to a signal at the multi-function terminal, wherein said current source is further associated with said frequency sweeping functionality.

27. A cold cathode fluorescent lamp controller according to claim 15, further comprising an error detection functionality arranged to output an error signal on the multi-function terminal.

28. A cold cathode fluorescent lamp controller according to claim 27, wherein said error detection functionality is arranged to couple the multi-functional terminal to a ground potential thereby outputting the error signal.

* * * * *